US011072877B2

(12) United States Patent
Jones et al.

(10) Patent No.: US 11,072,877 B2
(45) Date of Patent: Jul. 27, 2021

(54) AUTOMATIC TRANSFERRING WASHER AND DRYER COMBINATION APPLIANCE

(71) Applicants: Donald Jones, Birmingham, AL (US); Sharon Jones, Birmingham, AL (US)

(72) Inventors: Donald Jones, Birmingham, AL (US); Sharon Jones, Birmingham, AL (US)

( * ) Notice: Subject to any disclaimer, the term of this patent is extended or adjusted under 35 U.S.C. 154(b) by 154 days.

(21) Appl. No.: 16/420,300

(22) Filed: May 23, 2019

(65) Prior Publication Data

US 2020/0370221 A1 Nov. 26, 2020

(51) Int. Cl.

| | |
|---|---|
| ***D06F 29/00*** | (2006.01) |
| ***D06F 58/04*** | (2006.01) |
| ***D06F 37/04*** | (2006.01) |
| ***D06F 33/00*** | (2020.01) |

(52) U.S. Cl.

CPC ..... *D06F 29/005* (2013.01); *D06F 33/00* (2013.01); *D06F 37/04* (2013.01); *D06F 58/04* (2013.01)

(58) Field of Classification Search

CPC ..... D06F 29/00–02; D06F 37/28; D06F 34/28–34; D06F 39/02; D06F 39/022; D06F 39/028; D06F 39/14

See application file for complete search history.

(56) References Cited

U.S. PATENT DOCUMENTS

| | | | | |
|---|---|---|---|---|
| 271,815 | A | 2/1883 | Dolman | |
| 374,521 | A | 12/1887 | Chapman | |
| 3,545,235 | A | 12/1970 | Menk | |
| 5,481,248 | A | 1/1996 | Kruh | |
| 6,671,978 | B1 * | 1/2004 | McGowan | D06F 29/00 34/527 |
| 6,978,556 | B1 | 12/2005 | Cornelious | |
| 7,320,234 | B2 | 1/2008 | Hershey | |
| 7,404,303 | B1 * | 7/2008 | Barbosa | D06F 29/00 68/19.2 |
| 2003/0061841 | A1 * | 4/2003 | Nakamura | D06F 37/28 68/12.26 |
| 2005/0138835 | A1 * | 6/2005 | Lyu | D06F 58/30 34/596 |
| 2007/0169519 | A1 * | 7/2007 | Hershey | D06F 58/00 68/3 R |
| 2015/0121972 | A1 * | 5/2015 | Kim | D06F 34/28 68/3 R |

(Continued)

FOREIGN PATENT DOCUMENTS

| | | |
|---|---|---|
| WO | WO2009118236 | 10/2009 |

*Primary Examiner* — Michael E Barr
*Assistant Examiner* — Omair Chaudhri

(57) ABSTRACT

An automatic transferring washer and dryer combination appliance includes a washing unit and drying unit that are coupled to a housing and are positioned in an upper portion and a lower portion of the housing, respectively. A chute extends between the washing unit and the drying unit. A first orifice and a second orifice are positioned in a tub of the washing unit and a drum of the drying unit, respectively. A plurality of first doors and a plurality of second doors, which are coupled to the tub and to the drum, respectively, are positioned to selectively close the first orifice the second orifice, respectively. The first doors and the second doors are positioned to be selectively opened so that the first orifice and the second orifice align with the chute so that the chute is configured for gravitational transfer of washed articles from the tub to the drum.

7 Claims, 4 Drawing Sheets

(56) References Cited

U.S. PATENT DOCUMENTS

| | | | | |
|---|---|---|---|---|
| 2016/0273150 | A1* | 9/2016 | Del Pos | D06F 39/022 |
| 2018/0209084 | A1* | 7/2018 | Chakravarty | D06F 29/005 |
| 2018/0291545 | A1* | 10/2018 | Jones | D06F 58/30 |

* cited by examiner

AUTOMATIC TRANSFERRING WASHER AND DRYER COMBINATION APPLIANCE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to combination appliances and more particularly pertains to a new combination appliance for automatic transfer of articles from a washer and a dryer.

BRIEF SUMMARY OF THE INVENTION

An embodiment of the disclosure meets the needs presented above by generally comprising a washing unit and drying unit that are coupled to a housing and are positioned in an upper portion and a lower portion of the housing, respectively. A chute extends between the washing unit and the drying unit. A first orifice and a second orifice are positioned in a tub of the washing unit and a drum of the drying unit, respectively. A plurality of first doors and a plurality of second doors, which are coupled to the tub and to the drum, respectively, are positioned to selectively close the first orifice the second orifice, respectively. The first doors and the second doors are positioned to be selectively opened so that the first orifice and the second orifice align with the chute so that the chute is configured for gravitational transfer of washed articles from the tub to the drum.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
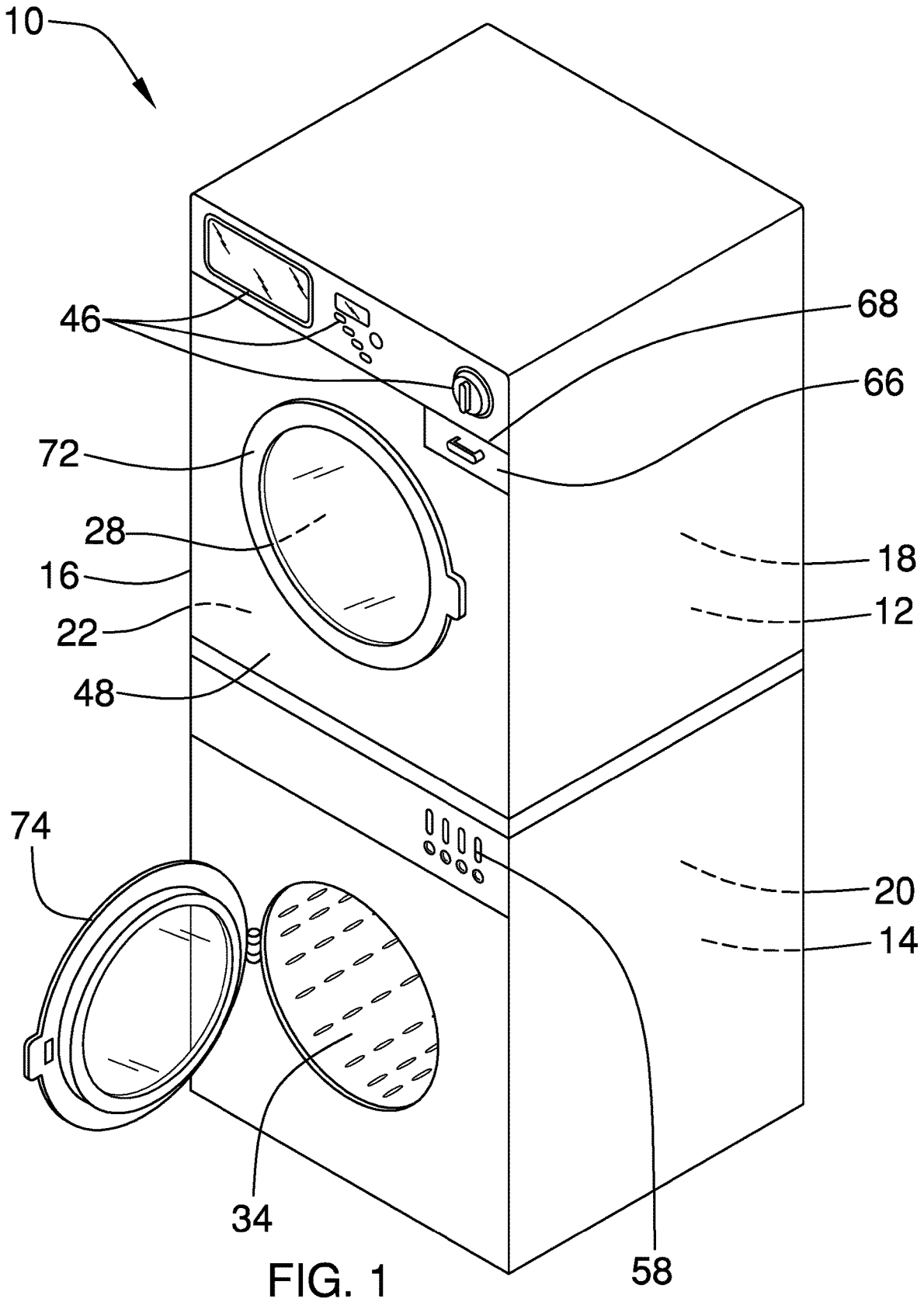
FIG. 1 is an isometric perspective view of an automatic transferring washer and dryer combination appliance according to an embodiment of the disclosure.

With reference now to the drawings, and in particular to FIGS. 1 through 4 thereof, a new combination appliance embodying the principles and concepts of an embodiment of the disclosure and generally designated by the reference numeral 10 will be described.

Figure 2:
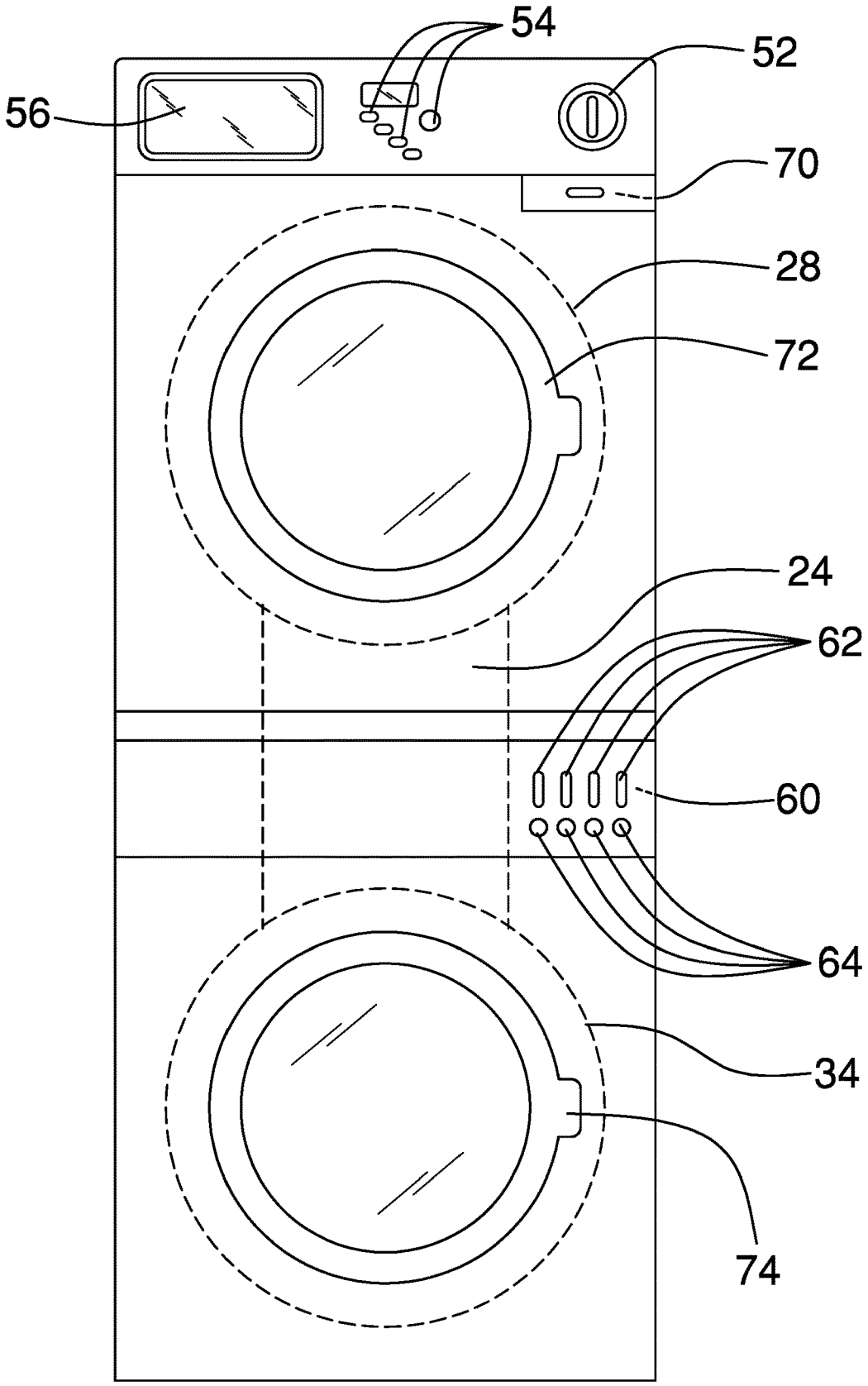
FIG. 2 is a front view of an embodiment of the disclosure.

As best illustrated in FIGS. 1 through 4, the automatic transferring washer and dryer combination appliance 10 generally comprises a washing unit 12 and a drying unit 14 that are coupled to a housing 16 and are positioned in an upper portion 18 and a lower portion 20, respectively, of an interior space 22 that is defined by the housing 16. A chute 24 extends between the washing unit 12 and the drying unit 14, as shown in FIG. 2.

Figure 3:
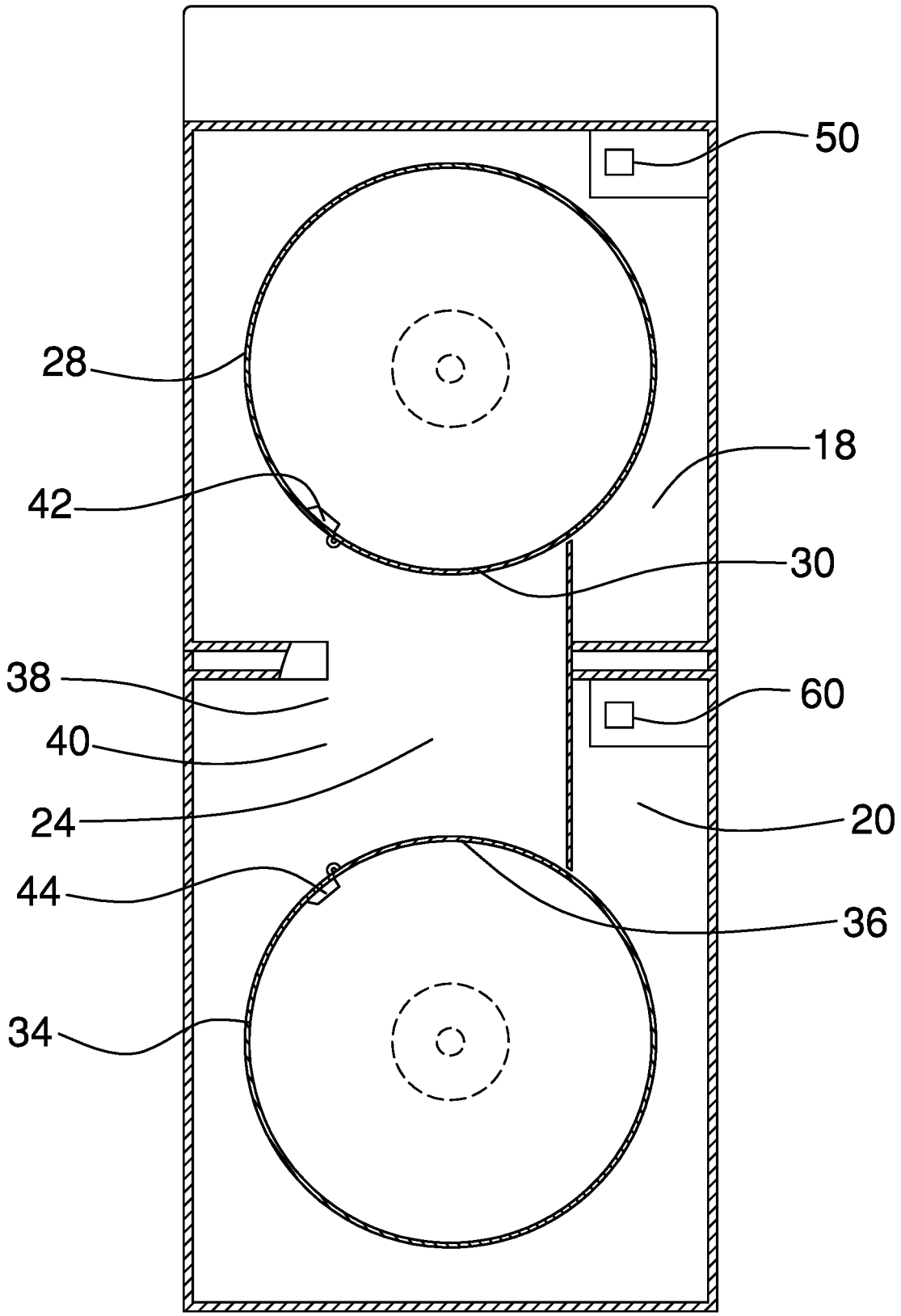
FIG. 3 is a cross-sectional view of an embodiment of the disclosure.

A first orifice 26 is positioned in a tub 28 of the washing unit 12. A plurality of first doors 30 that is coupled to the tub 28 is positioned to selectively close the first orifice 26, as shown in FIG. 3. The plurality of first doors 30 comprises one first door 30.

Figure 4:
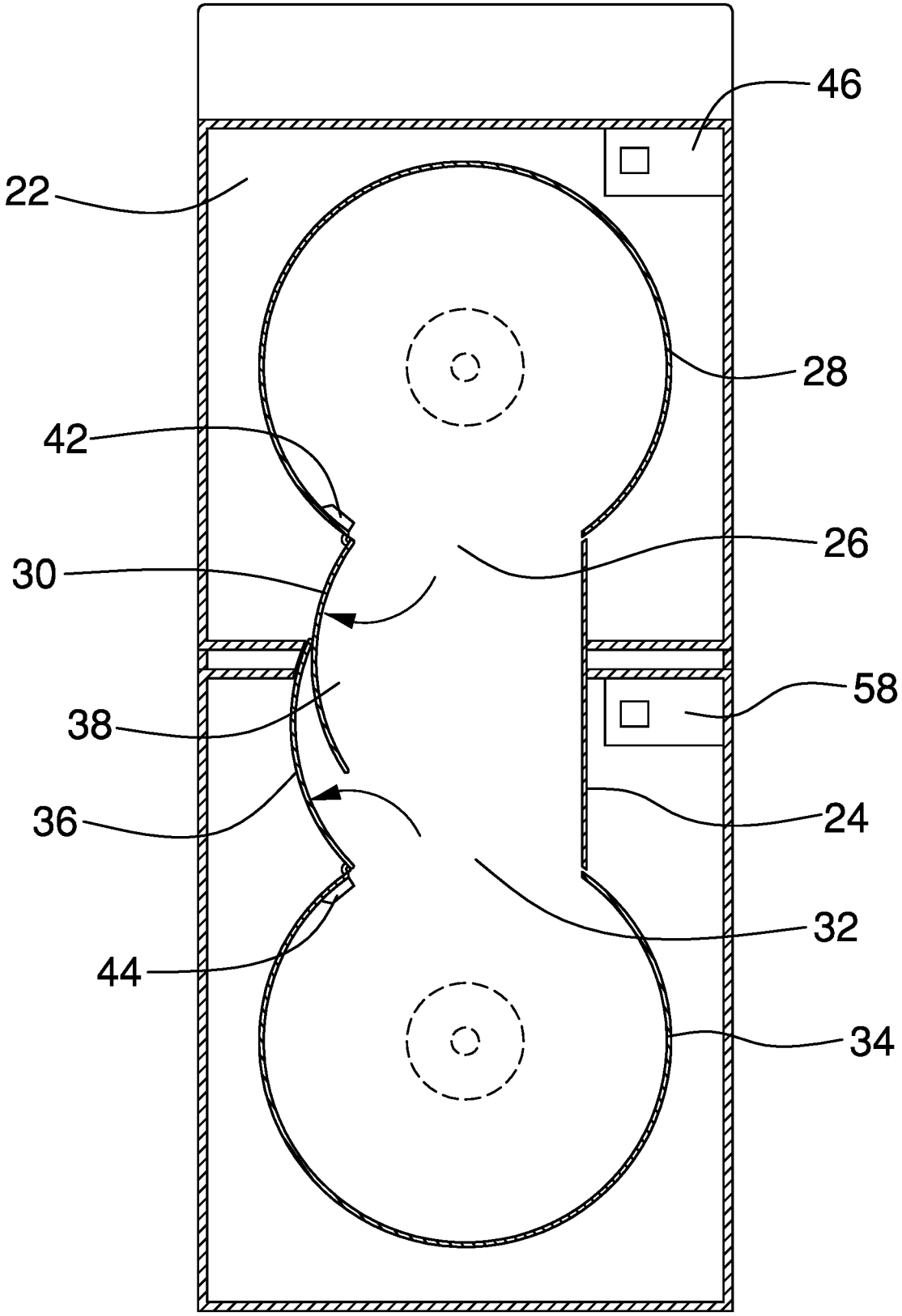
FIG. 4 is a cross-sectional view of an embodiment of the disclosure.

A second orifice 32 is positioned in a drum 34 of the drying unit 14. A plurality of second doors 36 that is coupled to the drum 34 is positioned to selectively close the second orifice 32, as shown in FIG. 3. The plurality of first doors 30 and the plurality of second doors 36 are positioned to be selectively opened so that the first orifice 26 and the second orifice 32 are aligned with the chute 24, as shown in FIG. 4, configuring the chute 24 for gravitational transfer of washed articles from the tub 28 to the drum 34. The plurality of second doors 36 comprises one second door 36.

An aperture 38 is positioned in a respective side face 40 of the chute 24, as shown in FIG. 3. The aperture 38 is positioned to insert the first door 30 and the second door 36 as the first door 30 and the second door 36 each are positioned in an associated open configuration to substantially close the aperture 38 and to open the chute 24 for the gravitational transfer of the washed articles from the tub 28 to the drum 34, as shown in FIG. 4. The second door 36 and the first door 30 sequentially assume their associated open configuration so that the first door 30 partially overlays the second door 36, as shown in FIG. 4.

A first actuator 42 is coupled to the tub 28 and is operationally coupled to the plurality of first doors 30. A second actuator 44 is coupled to the drum 34 and is operationally coupled to the plurality of second doors 36. A first controller 46 is coupled to a front 48 the housing 16 proximate to the washing unit 12, as shown in FIG. 2. The first controller 46 is operationally coupled to the washing unit 12, the first actuator 42, and the second actuator 44. The first controller 46 is positioned to selectively actuate the washing unit 12 to effect a washing cycle to wash soiled articles that are positioned in the tub 28. The first controller 46 then is positioned to selectively position the tub 28 and the drum 34 so that the first orifice 26 and the second orifice 32 are aligned with the chute 24, positioning the first controller 46 to actuate the first actuator 42 and the second actuator 44 to open the first door 30 and the second door 36, respectively, so that the washed articles are gravitationally transferred from the tub 28 to the drum 34.

The first controller 46 is positioned to repetitively and reversibly actuate the tub 28, effectively agitating the tub 28, to promote decoupling of the washed articles from the tub 28 so that the washed articles are gravitationally transferred from the tub 28 to the drum 34. The first controller 46 also may signal the first actuator 42 to close the first doors 30 prior to agitating the tub 28. The first controller 46 also may be programmed to signal a user when the washed articles have been transferred to the drum 34, positioning the user to initiate a subsequent wash cycle.

The first controller 46 comprises a first microprocessor 50, a knob 52, a plurality of first buttons 54, and a display 56. The knob 52, the plurality of first buttons 54, and the display 56 are operationally coupled to the first microprocessor 50. The first buttons 54 are touch actuated. The knob 52 is configured to be selectively rotated to a respective position that corresponds to an associated washing cycle, positioning the first microprocessor 50 to selectively actuate the washing unit 12 to effect the associated washing cycle. Each of the first buttons 54 is configured to be selectively touched to adjust a respective parameter of the associated washing cycle. The first microprocessor 50 is positioned to signal the display 56 to present the associated washing cycle and the respective parameter to the user.

A second controller 58 is coupled to the front 48 the housing 16 proximate to the drying unit 14, as shown in FIG. 2. The second controller 58 is operationally coupled to the drying unit 14. The second controller 58 is positioned to selectively actuate the drying unit 14 to effect a drying cycle to dry the articles that are positioned in the drum 34.

The second controller 58 comprises a second microprocessor 60, a plurality of second buttons 62, and a plurality of indicators 64. The plurality of second buttons 62 and the plurality of indicators 64 are operationally coupled to the second microprocessor 60. The second buttons 62 are touch actuated. Each of the second buttons 62 is configured to be selectively touched to select an associated drying cycle, positioning the second microprocessor 60 to selectively actuate the drying unit 14 to effect the associated drying cycle. The second microprocessor 60 also is positioned to selectively actuate a respective indicator 64 that corresponds to the associated drying cycle.

The combination appliance 10 also comprises a drawer 66 that is slidably extendable from the interior space 22 through a slot 68 that is positioned in the front 48 of the housing 16 proximate to the tub 28. A plurality of dispensing units 70 that is positioned in the drawer 66 is operationally coupled to the first controller 46. Each dispensing unit 70 is selectively fluidically couplable to the tub 28. The first controller 46 is positioned to selectively actuate a respective dispensing unit 70 to add an associated additive, such as detergent, bleach, and fabric softener, to the tub 28.

A washer door 72 is hingedly coupled to the front 48 of the housing 16 so that the washer door 72 is aligned with the tub 28. The washer door 72 is configured to swing to an open configuration, positioning a user to insert the soiled articles into the tub 28, and to swing to a closed configuration to close the tub 28.

A dryer door 74 is hingedly coupled to the front 48 of the housing 16 so that the dryer door 74 is aligned with the drum 34. The dryer door 74 is configured to swing to an open configuration, positioning a user to remove dried articles from the drum 34, and to swing to a closed configuration to close the drum 34.

In use, the soiled articles are positioned in the tub 28. A respective washing cycle and a respective drying cycle are selected by rotating the knob 52 to an associated position and by touching an associated second button 62, respectively. The washed articles are automatically transferred from the tub 28 of the washing unit 12 to the drum 34 of the drying unit 14 upon completion of the respective washing cycle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An automatic transferring washer and dryer combination appliance comprising:

a housing defining an interior space;

a washing unit coupled to the housing and positioned in an upper portion of the interior space;

a drying unit coupled to the housing and positioned in a lower portion of the interior space;

a chute coupled to and extending between the washing unit and the drying unit;

a first orifice positioned in a tub of the washing unit;

a first door coupled to the tub wherein the first door is positioned for selectively closing the first orifice;

a second orifice positioned in a drum of the drying unit; and a second door coupled to the drum wherein the second door is positioned for selectively closing the second orifice, wherein the first door and the second door are positioned for selectively opening such that the first orifice and the second orifice are aligned with the chute wherein the chute is configured for gravitational transfer of washed articles from the tub to the drum;

an aperture positioned in a respective side face of the chute wherein the aperture is positioned for inserting the first door and the second door as the first door and the second door each are positioned in an associated open configuration for substantially closing the aperture and opening the chute for the gravitational transfer of the washed articles from the tub to the drum, the second door and the first door sequentially assuming their associated open configuration such that the first door partially overlays the second door.

2. The combination appliance of claim 1, further comprising:

a first actuator coupled to the tub and operationally coupled to the first door;

a second actuator coupled to the drum and operationally coupled to the second door;

a first controller coupled to a front the housing proximate to the washing unit, the first controller being operationally coupled to the washing unit, the first actuator, and the second actuator wherein the first controller is configured for selectively actuating the washing unit for effecting a washing cycle for washing soiled articles positioned in the tub, the first controller being configured for selectively positioning the tub and the drum such that the first orifice and the second orifice are aligned with the chute, the first controller being configured for actuating the first actuator and the second actuator for opening the first door and the second door, respectively, such that the washed articles are gravitationally transferred from the tub to the drum; and a second controller coupled to the front the housing proximate to the drying unit, the second controller being operationally coupled to the drying unit, wherein the second controller is configured for selectively actuating the drying unit for effecting a drying cycle for drying the articles positioned in the drum.

3. The combination appliance of claim 2, further including the first controller being configured for repetitively and reversibly actuating the tub for promoting decoupling of the washed articles from the tub such that the washed articles are gravitationally transferred from the tub to the drum.

4. The combination appliance of claim 2, further comprising:

the first controller comprising a first microprocessor, a knob, a plurality of first buttons, and a display, the knob, the plurality of first buttons, and the display being operationally coupled to the first microprocessor, the first buttons being touch actuated, wherein the knob is configured for selectively rotating to a respective position corresponding to an associated washing cycle configuring the first microprocessor for selectively actuating the washing unit for effecting the associated washing cycle, wherein each of the first buttons is configured for being selectively touched for adjusting a respective parameter of the associated washing cycle and wherein the first microprocessor is configured for signaling the display for presenting the associated washing cycle and the respective parameter to the user; and the second controller comprising a second microprocessor, a plurality of second buttons, and a plurality of indicators, the plurality of second buttons and the plurality of indicators being operationally coupled to the second microprocessor, the second buttons being touch actuated wherein each of the second buttons is configured for being selectively touched for selecting an associated drying cycle configuring the second microprocessor for selectively actuating the drying unit for effecting the associated drying cycle and wherein the second microprocessor is configured for selectively actuating a respective indicator corresponding to the associated drying cycle.

5. The combination appliance of claim 2, further comprising:

a drawer slidably extendable from the interior space through a slot positioned in the front of the housing proximate to the tub; and a plurality of dispensing units positioned in the drawer, each dispensing unit being selectively fluidically couplable to the tub, the plurality of dispensing units being operationally coupled to the first controller wherein the first controller is configured for selectively actuating a respective dispensing unit for adding an associated additive to the tub.

6. The combination appliance of claim 1, further comprising:

a washer door hingedly coupled to the front of the housing such that the washer door is aligned with the tub wherein the washer door is configured for swinging to an open configuration allowing a user to insert soiled articles into the tub and for swinging to a closed configuration for closing the tub; and a dryer door hingedly coupled to the front of the housing such that the dryer door is aligned with the drum wherein the dryer door is configured for swinging to an open configuration allowing a user to remove dried articles from the drum and for swinging to a closed configuration for closing the drum.

7. An automatic transferring washer and dryer combination appliance comprising:

a housing defining an interior space;

a washing unit coupled to the housing and positioned in an upper portion of the interior space;

a drying unit coupled to the housing and positioned in a lower portion of the interior space;

a chute coupled to and extending between the washing unit and the drying unit;

a first orifice positioned in a tub of the washing unit;

a first door coupled to the tub wherein the first door is positioned for selectively closing the first orifice;

a second orifice positioned in a drum of the drying unit;

a second door coupled to the drum wherein the second door is positioned for selectively closing the second orifice, wherein the first door and the second door are positioned for selectively opening such that the first orifice and the second orifice are aligned with the chute wherein the chute is configured for gravitational transfer of washed articles from the tub to the drum;

an aperture positioned in a respective side face of the chute wherein the aperture is positioned for inserting the first door and the second door as the first door and the second door each are positioned in an associated open configuration for substantially closing the aperture and opening the chute for the gravitational transfer of the washed articles from the tub to the drum, the second door and the first door sequentially assuming their associated open configuration such that the first door partially overlays the second door;

a first actuator coupled to the tub and operationally coupled to the first door;

a second actuator coupled to the drum and operationally coupled to the second door;

a first controller coupled to a front the housing proximate to the washing unit, the first controller being operationally coupled to the washing unit, the first actuator, and the second actuator wherein the first controller is configured for selectively actuating the washing unit for effecting a washing cycle for washing soiled articles positioned in the tub, the first controller being configured for selectively positioning the tub and the drum such that the first orifice and the second orifice are aligned with the chute, the first controller being configured for actuating the first actuator and the second actuator for opening the first door and the second door, respectively, such that the washed articles are gravitationally transferred from the tub to the drum, the first controller being configured for repetitively and reversibly actuating the tub for promoting decoupling of the washed articles from the tub such that the washed articles are gravitationally transferred from the tub to the drum, the first controller comprising a first microprocessor, a knob, a plurality of first buttons, and a display, the knob, the plurality of first buttons, and the display being operationally coupled to the first microprocessor, the first buttons being touch actuated, wherein the knob is configured for selectively rotating to a respective position corresponding to an associated washing cycle configuring the first microprocessor for selectively actuating the washing unit for effecting the associated washing cycle, wherein each of the first buttons is configured for being selectively touched for adjusting a respective parameter of the associated washing cycle and wherein the first microprocessor is configured for signaling the display for presenting the associated washing cycle and the respective parameter to the user;

a second controller coupled to the front the housing proximate to the drying unit, the second controller being operationally coupled to the drying unit, wherein the second controller is configured for selectively actuating the drying unit for effecting a drying cycle for drying the articles positioned in the drum, the second controller comprising a second microprocessor, a plurality of second buttons, and a plurality of indicators, the plurality of second buttons and the plurality of indicators being operationally coupled to the second microprocessor, the second buttons being touch actuated wherein each of the second buttons is configured for being selectively touched for selecting an associated drying cycle configuring the second microprocessor for selectively actuating the drying unit for effecting the associated drying cycle and wherein the second microprocessor is configured for selectively actuating a respective indicator corresponding to the associated drying cycle;

a drawer slidably extendable from the interior space through a slotsitioned in the front of the housing proximate to the tub;

a plurality of dispensing units positioned in the drawer, each dispensing unit being selectively fluidically couplable to the tub, the plurality of dispensing units being operationally coupled to the first controller wherein the first controller is configured for selectively actuating a respective dispensing unit for adding an associated additive to the tub;

a washer door hingedly coupled to the front of the housing such that the washer door is aligned with the tub wherein the washer door is configured for swinging to an open configuration allowing a user to insert the soiled articles into the tub and for swinging to a closed configuration for closing the tub; and a dryer door hingedly coupled to the front of the housing such that the dryer door is aligned with the drum wherein the dryer door is configured for swinging to an open configuration allowing a user to remove dried articles from the drum and for swinging to a closed configuration for closing the drum.

* * * * *